US008905157B2

(12) United States Patent
Jiao et al.

(10) Patent No.: US 8,905,157 B2
(45) Date of Patent: Dec. 9, 2014

(54) CONTROL SYSTEM, ROCK DRILL RIG AND CONTROL METHOD

(75) Inventors: Deyi Jiao, Plano, TX (US); Eugene Cheng, Plano, TX (US); Jonas Sinnerstad, Örebro (SE); Hans Gustavsson, Örebro (SE)

(73) Assignees: Atlas Copco Rock Drills AB, Orebro (SE); Atlas Copco Drilling Solutions LLC, Garland, TX (US)

( * ) Notice: Subject to any disclaimer, the term of this patent is extended or adjusted under 35 U.S.C. 154(b) by 467 days.

(21) Appl. No.: 13/261,073

(22) PCT Filed: Jun. 28, 2010

(86) PCT No.: PCT/SE2010/000184

§ 371 (c)(1),
(2), (4) Date: Dec. 8, 2011

(87) PCT Pub. No.: WO2010/151203

PCT Pub. Date: Dec. 29, 2010

(65) Prior Publication Data

US 2012/0085584 A1 Apr. 12, 2012

(51) Int. Cl.

| | |
|---|---|
| ***E21B 44/00*** | (2006.01) |
| ***E21B 44/06*** | (2006.01) |
| *E21B 47/00* | (2012.01) |
| *E21B 1/00* | (2006.01) |
| *G05D 9/00* | (2006.01) |
| *G05D 7/00* | (2006.01) |

(52) U.S. Cl.
CPC ..... *E21B 44/06* (2013.01)
USPC ..... 175/24; 175/38; 175/40; 175/51; 700/281; 700/282

(58) Field of Classification Search
CPC ..... E21B 44/06
USPC ..... 700/281–282; 137/2, 7–8, 10; 175/24–25, 38, 40, 51
See application file for complete search history.

(56) References Cited

U.S. PATENT DOCUMENTS

| | | | | |
|---|---|---|---|---|
| 4,854,397 | A | 8/1989 | Warren et al. | |
| 5,095,806 | A * | 3/1992 | Valdemar et al. | 91/433 |
| 6,209,662 | B1 | 4/2001 | Stahl | |
| 6,233,524 | B1 * | 5/2001 | Harrell et al. | 702/9 |
| 6,467,557 | B1 * | 10/2002 | Krueger et al. | 175/45 |

(Continued)

FOREIGN PATENT DOCUMENTS

| | | |
|---|---|---|
| EP | 1 988 438 | 11/2008 |

*Primary Examiner* — Ramesh Patel
(74) *Attorney, Agent, or Firm* — Mark P. Stone

(57) ABSTRACT

A hydraulic fluid control system for controlling pressure fluid supplied to consumers (2, 3, 4) of a rock drilling machine, a regulating valve (6, 7, 8) for each for each consumer and fluid conduits between the regulating valves and the consumers, an electronically controlled auxiliary control unit (11) having an electrically controlled auxiliary valve (14) for connection to a fluid conduit, a sensor for sensing fluid parameter values and sending sensor signals to the auxiliary control unit as sensor input signal actual values, micro-controller (12) having at least one parameter sensor input signal entry (S1-S5, I1-I5) for receiving the sensor input signal actual values and a control signal exit (V1-V6) for signal control of an auxiliary valve, the processor (12) is being arranged to compare the actual and predetermined values and to emit control signals to an auxiliary valve in response to the comparison to adjust fluid flow.

20 Claims, 3 Drawing Sheets

(56) References Cited

U.S. PATENT DOCUMENTS

| | | | | |
|---|---|---|---|---|
| 6,505,689 | B1 * | 1/2003 | Poysti et al. | 173/4 |
| 6,637,522 | B2 * | 10/2003 | Wilson et al. | 175/25 |
| 6,651,755 | B1 | 11/2003 | Kelpe | |
| 6,772,134 | B1 | 8/2004 | Jacubasch et al. | |
| 7,172,037 | B2 | 2/2007 | Dashevskiy et al. | |
| 7,503,409 | B2 * | 3/2009 | Brookover | 175/135 |
| 2002/0112893 | A1 * | 8/2002 | Bischel et al. | 175/61 |
| 2003/0089506 | A1 * | 5/2003 | Ayler et al. | 166/387 |
| 2007/0240903 | A1 | 10/2007 | Alft et al. | |
| 2008/0223467 | A1 | 9/2008 | Tveita | |

* cited by examiner

CONTROL SYSTEM, ROCK DRILL RIG AND CONTROL METHOD

The present patent application is the United States National Phase of PCT/SE2010/000184, filed on Jun. 28, 2010, pursuant to 35 U.S.C. 371; which claims the benefit of PCT/US09/03845, filed Jun. 26, 2009, pursuant to 35 U.S.C 365(c).

FIELD OF THE INVENTION

The invention concerns a control system for the control of pressure fluid supply to consumers being a feed motor, a percussion device and a rotation motor of a rock drilling machine, said system including a regulating valve for each one of the consumers, wherein fluid conduits lead between the regulating valves and the respective consumers. The invention also concerns a rock drill rig including such a system and a control method.

BACKGROUND OF THE INVENTION

In a conventional rock drilling process, drilling parameters are set manually by a skilled operator through directly manipulating the different main hydraulic control valves. Although experienced operators can be said to have some feel for when a rock drilling process is running effectively, there is much to be wished when it comes to total control over the drilling process in order to drill more efficient while taking account on how the equipment should be operated most effectively and still avoid excessive wear, overload, component failure etc.

In a more recent system there has been suggested to proceed so as to tune the system in the direction of optimizing of the drilling process in order to improve drilling quality. This is achieved through direct control of the operational parameters such as drill feed force, rotation speed and hammer power level. Various anti jamming functions are typically also used in the known control system in order to avoid unnecessary down times.

Such a control system can be a very complicated hydraulic system with highly customized valves, a complete electro-hydraulic system with some type of micro-controller and possible CAN (Controller Area Network) bus technology, or a combination of both to handle the complex logics. In particular, the control is undertaken through control signals for regulating the different main hydraulic control valves so as to control drill feed force, rotation speed, hammer power level etc.

AIM AND MOST IMPORTANT FEATURES OF THE INVENTION

It is an aim with this invention to present a system of the kind indicated initially which provides a more flexible and economic solution than the above described more recent system.

This is achieved according to the invention in a system as initially indicated through a an electronically controlled auxiliary control unit which includes at least one electrically controlled auxiliary valve for the connection to and intercepting in at least one of the fluid conduits, at least one sensor for sensing prevailing fluid parameter values in at least one member of the rock drilling machine and sending sensor signals to the auxiliary control unit as sensor input signal is-values, and a processor having at least one parameter sensor input signal entry for receiving said sensor input signal is-values and at least one control signal exit for signal control of a respective auxiliary valve, wherein the processor is arranged to compare said sensor input signal is-values with parameter should-values and to emit control signals to at least one of the auxiliary valves as a response to the result of the comparison in order to adjust fluid flow in the fluid conduit related to said at least one of the auxiliary valves.

This makes it possible to simplify in particular the hydraulic side of the control system and to use standard hydraulic equipment.

The inventive control system can advantageously be docked to an existing "non-intelligent" drill rig so as to make it drill with higher productivity, more economic and safer.

The term "members of the rock drilling machine" in the independent claims is intended to include the consumers as well as drilling machine damping arrangement and flushing air or water arrangement.

Parameter should-values can be individual parameter limits, parameter ranges and/or parameter target values that are empirically set according to experience and previous test. It is also possible that the inventive system evaluates combinations of parameter values for different parameters so as to avoid unwanted combination of per se allowable individual parameter values.

The term fluid includes here on the one hand hydraulic control fluid which in practice is used for supply to the consumers in the form of the feed motor, the percussion device and the rotation motor of the rock drilling machine. The term includes on the other hand also flushing air or water for flushing away cuttings from the front of the drill bit.

It is preferred that fluid parameter values are from one or more from the group: feed motor pressure, percussion pressure and rotation motor pressure related to the consumers, and the further parameters: flushing air or water pressure and damping pressure. All these parameters are easily monitored and indicative of the prevailing condition in the operative components.

The system includes preferably user input entry means for allowing an operator to enter data related to one or more from the group: drill bit properties, drill rod properties, rock properties, requested drill mode.

The auxiliary control system is advantageously a plug-in system for the adaption to a previously existing manual system which makes it even simpler to dock with the existing system.

The auxiliary control system includes preferably at least one sensor from the group: feed pressure sensor, rotation pressure sensor, impact hammer pressure sensor. The auxiliary control system includes further advantageously at least one flushing fluid (air; water) pressure sensor.

The auxiliary valves include advantageously fluid restriction and/or fluid reversing capabilities for the respective fluid conduits whereby fluid flow can be influenced as to its magnitude or, in respect of certain requirements be reversed for reverse function of a consumer.

When the auxiliary control unit includes means for initiating a drilling operation sequence according to certain parameter data level/combination, said sequences can preferably include any one functionality from the group: anti jamming, anti plunging, anti plugging, synchronized threading and hammer power regulating.

Corresponding advantages are obtained by a control method characterized by the corresponding features.

In this text, the terms "include", "includes", "including", "included" are to be interpreted broadly and not limited to a following element or feature.

BRIEF DESCRIPTION OF DRAWINGS

The invention will now be described by way of an embodiment and at the background of drawings, wherein.

DESCRIPTION OF EMBODIMENT

Figure 1:
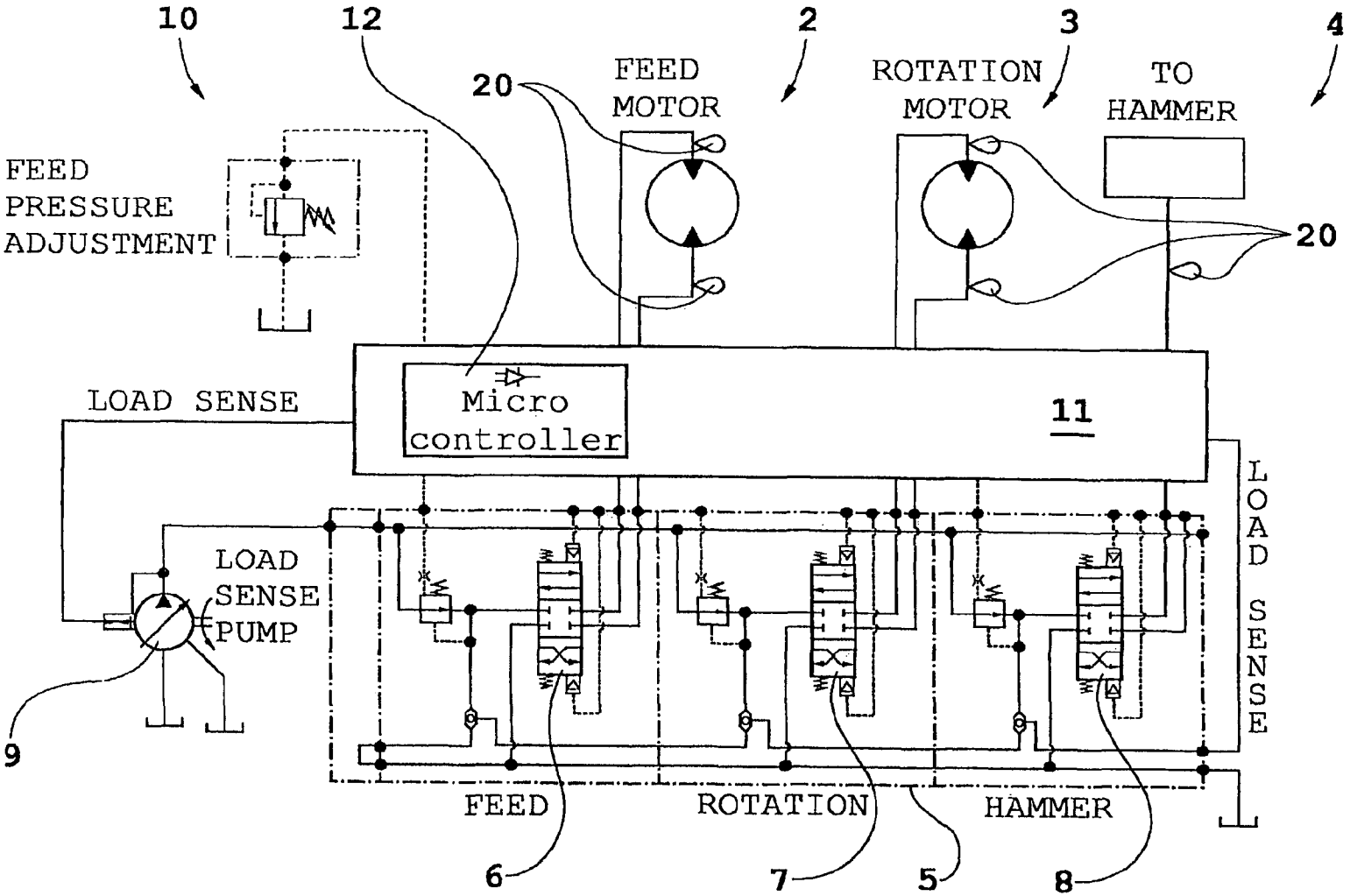
FIG. 1 is a diagrammatical representation of a drill rig control system.

In FIG. 1 is indicated a control system for a rock drill rig. A number of consumers: a feed motor 2, a rotation motor 3 and a percussive device or hammer 4 are connected over fluid conduits being hydraulic fluid to an operator controlled basic control system 5 (within dash dotted lines). The basic control system 5 includes regulating valves 6, 7 and 8, for the feed, the rotation, and the hammer, respectively, that are operator controlled. A pump of a load sensing type is indicated with 9 and a pressure limiting valve with 10.

An electronically controlled auxiliary control unit 11 is interconnected in the fluid conduits so as to intercept in at least one of the fluid conduits. The auxiliary control unit includes at least one electronically controlled auxiliary valve for the connection to the respective fluid conduit and at least one sensor 20 for sensing prevailing fluid parameter values in at least one of the consumers 2-4. Sensor signals are sent over (not shown) signal cables to the auxiliary control unit as sensor input signal is-values (actual values). A processor such as micro-controller 12 inside the auxiliary control unit with at least one parameter sensor input signal entry receives said sensor input signal is-values (actual values) and delivers at least one control signal for signal control of a respective auxiliary valve. In particular the processor is arranged to compare said sensor input signal is-values (actual values) with parameter should-values (predetermined values) that are stored in a memory, or instantly calculated, and to emit control signals to at least one of the auxiliary valves as a response to the result of the comparison in order to adjust fluid flow in the fluid conduit related to said at least one of the auxiliary valves.

In practice, the auxiliary control unit is an autonomic plug-in system which provides a method to control a rock drill and a drilling process in the direction of optimization of the operation.

Among the unique features can be mentioned:

1. The inventive system can bee seen as an add-on system to a primary manual or semi manual drilling control system.
2. It is an electronics-over-hydraulic hybrid system with intelligent controllability.
3. The system can add optimization functions to the original control system.
4. The system can start sequences and time controlled functions.
5. The advantage of such a system is that it can be removed or turned off without affecting normal manual control functionalities.
6. The system is simple in design and is readily designed with a rich number of functionalities.
7. The function is mainly obtained through intercepting the actual hydraulic flow coming out of the regulating valves. This gives the user a lot of flexibility when choosing a drilling control system.
8. The system is readily embodied through e.g. a micro-controller unit in combination with sensors and hydraulic valves. The system uses hydraulic components only as actuators to control hydraulic flow and pressure. This makes the system less sensitive to mechanical properties of rig components, temperature variation influences and manufacturing tolerances.
9. There is no hydraulic logic built in the system. Instead a processor is used to handle logic functions. Hereby it is possible to use fewer components and standard components. This combination of hydraulics and processor power enables a simplified hydraulic system and associated low costs for components and for assembly time.

Further, the inventive system monitors the hydraulic system parameters through the sensors, as above, and makes adjustment to the fluid flow in the direction of optimizing the system performance. Sensors are also advantageously used for measuring air flow (flush) rate/pressure.

Figure 2:
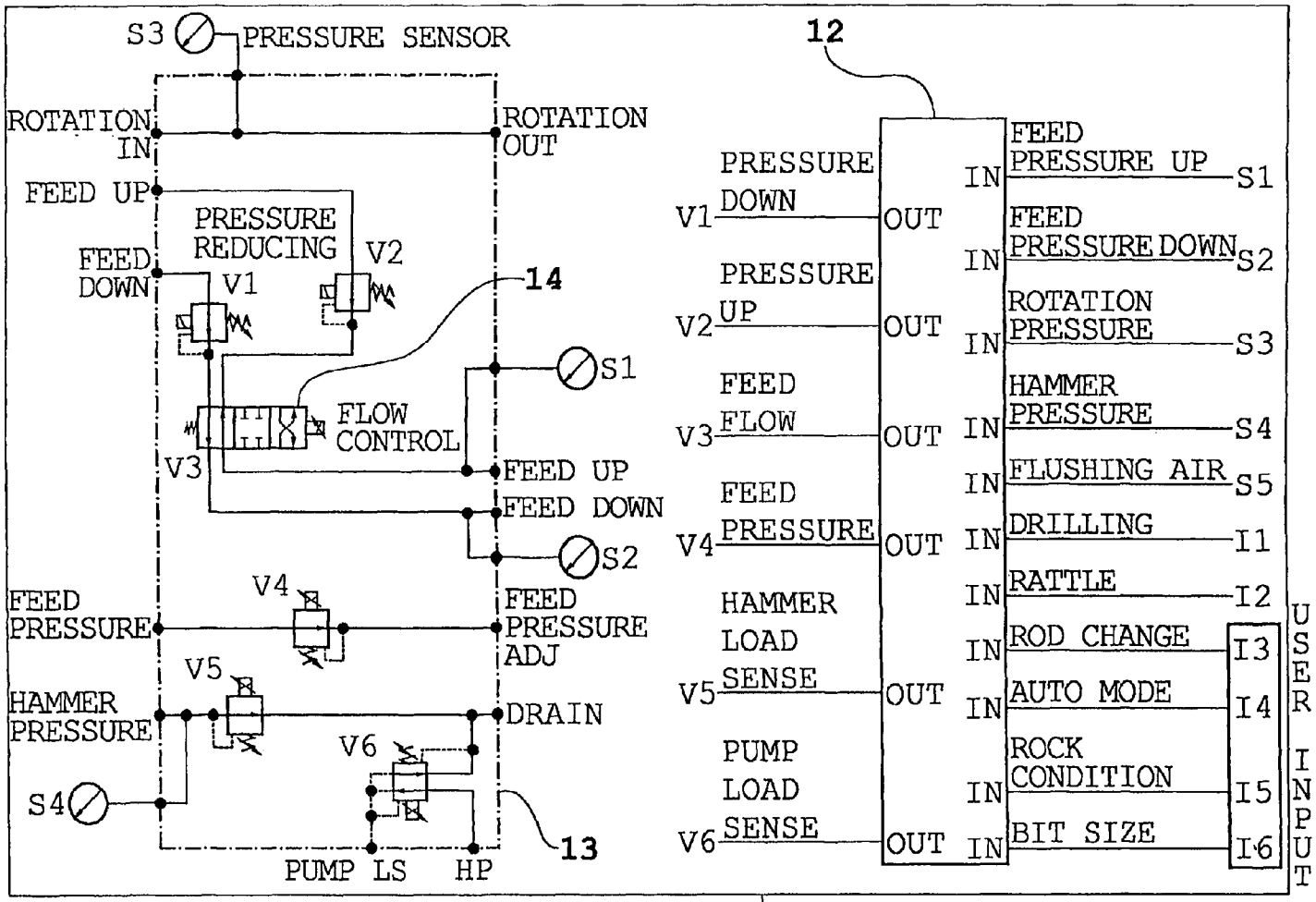
FIG. 2 is a representation illustrating the working principle of the inventive control system.

In FIG. 2, the auxiliary control system is indicated with generally the electronic components in the micro-controller 12 having sensor and operator entries S1-S5 (Feed Pressure Up, Feed Pressure Down, Rotation Pressure, Hammer Pressure, Flushing Air, respectively) and 11-16 (Drilling, Rattle, Rod Change, Auto Mode, Rock Condition, Bit Size, respectively). Control exits for auxiliary valve control output signals are indicated with V1-V6 (Pressure Down, Pressure Up, Feed Flow, Feed Pressure, Hammer Load Sense, Pump Load Sense, respectively).

13 indicates the "hydraulic side" of the auxiliary control unit which includes valves etc. In the figure is only shown, as an example, a flow control valve 14, which in this case is a feed flow regulating valve.

Figure 3:
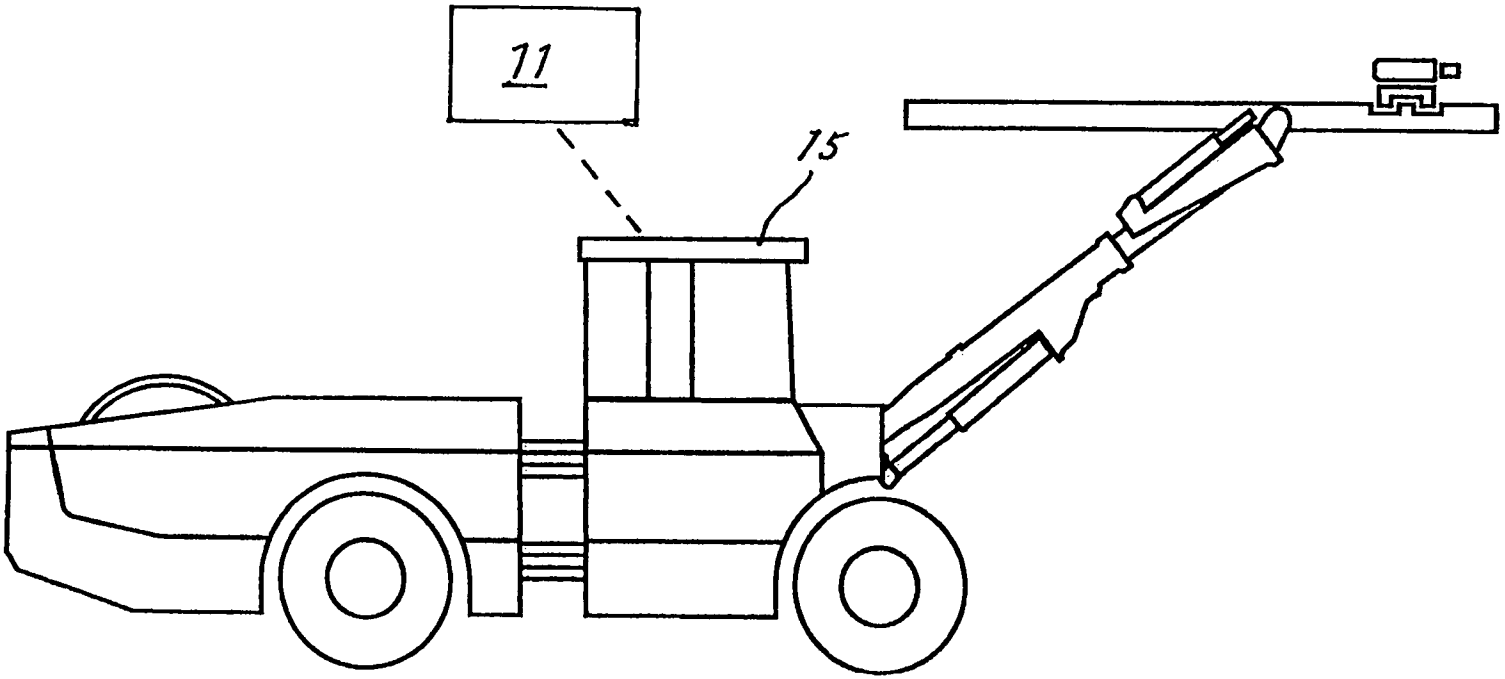
FIG. 3 is a diagrammatical representation of a drill rig including a control system according to the invention.

FIG. 3 shows very diagrammatically a drill rig 15 of a per se known type but equipped with an auxiliary control unit 11 according to the invention.

A user input device can also be used to modify the program functions in the unit. The system can optimize feed pressure, feed speed, hammer pressure and pump pressure and take account also on user input data related to one or more from the group: drill bit properties, drill rod properties, rock properties, requested drill mode.

According to embodiments of the invention, different drilling operation sequences can be initiated with functionalities such as anti jamming, anti plunging, anti plugging, synchronized threading and hammer power regulating.

These functionalities will prevent the drill bit from getting stuck when drilling in fractured rock formations causes increased rotation torque level, drilling through void at high penetration rate risks harmful impact after void, drilling through mud which may lead to plugged air or water flushing holes in the drill bit risks excessive wear and low to zero penetration rate.

Synchronized threading is used when connecting and disconnecting drill rods in order to prevent that too high feed force is exerted on the threads, so as to prevent premature failure of the coupling or rods. Regulating percussion pressure and hammer power aims at reducing the hammer power when feed force is reduced to prolong component working life. In particular the inventive system makes it possible to expand the working life of the shank or drill steel.

Feed pressure depends on rotation torque (rotation pressure) while the relationship between these two parameters is a function for example of rock condition and bit sizes. User inputs can be used to modify this relationship. Feed pressure is also dependent on feed direction, whereby feed pressure is at its maximum at "feed up". Percussion pressure is dependent on feed pressure and their relationship can also be modified by user inputs.

According to a preferred embodiment of the invention, the auxiliary control unit intervenes in the fluid conduits to all consumers and tunes the entire drilling operation by adjusting the fluid flows and the pressures so as to obtain drilling operation where the parameters are tuned to each other even though there are altering conditions.

Stored data are based on functions derived from empirical data. These functions can be decisive to what extent each hydraulic actuator is to be adjusted (or to what extent each hydraulic valve is to be actuated) based on inputs from sensors and inputs from the drill operator.

When operator input is not in auto mode, all the hydraulic components return to neutral mode and all the functions inside the micro-controller (processor) are disabled so as to revert the system to full manual mode. If the processor has lost power or has broken down, the system will also revert to full manual mode. The operator can thus continue drilling in manual mode. All the hydraulic flow going through the system will have zero flow restriction and zero pressure reduction. This is a great advantage, since drilling can be continued and terminated in the manual mode even after a possible control system failure. This is not possible in previously known control systems, where corresponding failure would have led to complete rig stand-still.

If a rotation pressure sensor detects that pressure has increased above certain limits, the feed pressure and flow may be reduced to an amount determined by the processor based on i.a. operator input of bit size and rock conditions. This is called an anti jam function to prevent drill bit from getting stuck in the hole and lost production time.

The feed pressure can continue to decrease as long as rotation pressure stays beyond the preset limit.

If rotation pressure stays higher than a preset limit, the feed flow will eventually advantageously be reversed and feed pressure maximized to get released from a potential jamming condition.

Maximum feed flow will advantageously be limited based on operator inputs of rock condition and bit size. This is to limit maximum drilling speed to prevent plunging condition when drilling through void or extremely soft rock formations. Plunging condition happens when the drill bit hits solid ground after drilling though a void at very high speed. This can cause severe hole deviation, damage equipment or the drill string getting stuck. The bit can then easily get jammed if the operation is not controlled.

Feed force is used to keep the drill bit into contact with the rock all the time so as to ensure efficient transmission of impact energy from the hammer to the rock. The level of feed force needed is a direct function of impact energy to be transferred to the rock. Once feed force is reduced by an anti jamming function, hammer impact power will be reduced at the same time, based on the feed pressure. This will reduce the damage to the drill rod, shank and couplings from unused impact energy.

Feed pressure as well as damping pressure can be used as parameters to describe feed force.

Pump load is also preferably controlled by the system to improve drill rig efficiency and to stabilize the hydraulic system. This control is based on mode of the drilling system and status of the drilling parameters.

Compressed air is used in rock drilling to flush out the rock cuttings in order to ensure an efficient rock breaking process and to prevent jamming of the drill bit. If the cuttings were not cleaned away immediately, the drill bit would repeatedly impact on the cuttings accumulated at the bottom of the hole. This secondary breakage process will only produce very fine rock power and waste a lot of impact energy. The other major effect is that the accumulated cuttings behind the drill bit would jam the bit very quickly, and make it very hard to remove the drill bit and steel out of the hole. When the flushing holes in the drill bit gets plugged, such as when drilling through mud, the air flow can be stopped. A flow sensing device is therefore preferably installed in the air flow path to detect the flow condition. Once air flow is stopped, a signal will be sent by the processor whereupon the feed direction will be reversed immediately. This function in the processor is called anti-plugging.

During rod handling, drilling rods will be connected or disconnected, increasing or reducing drilling string length. Drill rods are connected over threaded coupling devices. The rotations of the drill rods and their linear movements have to be synchronized to prevent damages of the threads. The inventive system can have the capability to synchronize the drill feed and rotation by regulating feed flow and pressure in different directions.

The system can also have manual adjustment capabilities for fail safe protections. Examples are hammer minimum pressure, hammer maximum pressure and pump maximum pressure. There are built in safety lock functions to further prevent any dangerous situation.

The system has preferably extensive diagnostic capabilities due to the use of processor and sensors. Fault conditions can be stored in the internal memory for later down-loading and analysis.

If the system has e.g. a CAN communication protocol it provides the necessary means to network with other systems and MMI devices. Also other means of communication can be envisaged.

When it comes to the processor, it includes preferably comparator circuitry being arranged to perform the comparing between said is-values and should-values.

Preferably the system includes operator display and interface means such as indicators, screens etc for alerting the operator about system operation.

In an inventive method for the control of pressure fluid supply to consumers being a feed motor, a percussion device and a rotation motor of a rock drilling machine, the following method steps are performed for regulating fluid in conduits leading between regulating valves and the respective consumers through a regulating valve for each one of the consumers:

a. connection to and intercepting in at least one of the fluid conduits is undertaken by an electronically controlled auxiliary control unit which includes at least one electrically controlled auxiliary valve,
b. prevailing fluid parameter values in respect of at least one member of the rock drilling machine are sensed by at least one sensor, and
c. sensor signals are sent to the auxiliary control unit as sensor input signal is-values,
d. a processor having at least one parameter sensor input signal entry receives said sensor input signal is-values and exits at least one control signal for signal control of a respective auxiliary valve,
e. said sensor input signal is-values are compared with parameter should-values by the processor, and
f. control signals are emitted to at least one of the auxiliary valves as a response to the result of the comparison in order to adjust fluid flow in the fluid conduit related to said at least one of the auxiliary valves.

The invention can be modified within the scope of the claims, i.a. the inventive method can be complemented with further method features corresponding to the above listed system features.

The invention claimed is:

1. Control system for the control of pressure fluid supply to consumers being a feed motor, a percussion device and a rotation motor of a rock drilling machine, said system including a regulating valve for each one of the consumers, wherein fluid conduits lead between the regulating valves and the respective consumers, the system having:

an electronically controlled auxiliary control unit which includes at least one electrically controlled auxiliary valve for the connection to and intercepting in at least one of the fluid conduits, at least one sensor for sensing prevailing fluid parameter values in respect of at least one member of the rock drilling machine and sending sensor signals to the auxiliary control unit as a sensor input signal actual values, and a processor having at least one parameter sensor input signal entry for receiving said sensor input signal actual values and at least one control signal exit for signal control of a respective auxiliary valve, wherein the processor is arranged to compare said sensor input signal actual values with parameter predetermined values and to emit control signals to at least one of the auxiliary valves as a response to the result of the comparison in order to adjust fluid flow in the fluid conduit related to said at least one of the auxiliary valves.

2. System according to claim 1, wherein it is arranged to process fluid parameter values from one or more from the group: feed motor pressure, percussion pressure and rotation motor pressure being related to the consumers, and the further parameters:

flushing air pressure, flushing water pressure and damping pressure.

3. System according to claim 2, wherein the system includes user input entry means for allowing an operator to enter data related to one or more from the group: drill bit properties, drill rod properties, rock properties, requested drill mode.

4. System according to claim 2, wherein the auxiliary control system is a plug-in system for the adaption to a previously existing manual system.

5. System according to claim 2, wherein the auxiliary control system includes at least one sensor from the group: feed pressure sensor, rotation pressure sensor, impact hammer pressure sensor.

6. System according to claim 2, wherein the auxiliary control system includes at least one flushing air or flushing water pressure sensor.

7. Rock drill rig including a carrier vehicle with a feed beam whereon is movably supported a rock drilling machine, wherein a hydraulic fluid control system according to claim 2 is included for the control of pressure fluid supply to consumers being a feed motor, a percussion device and a rotation motor, said system including a regulating valve for each one of the consumers, wherein fluid conduits lead between the regulating valves and the respective consumers, the system having:

an electronically controlled auxiliary control unit which includes at least one electronically controlled auxiliary valve for the connection to and intercepting in at least one of the fluid conduits, at least one sensor for sensing prevailing fluid parameter values in respect of at least one member of the rock drilling machine and sending sensor signals to the auxiliary control unit as a sensor input signal actual values, and a processor having at least one parameter sensor input signal entry for receiving said sensor input signal actual values and at least one control signal exit for signal control of a respective auxiliary valve, wherein the processor is arranged to compare said sensor input signal actual values with parameter predetermined values and to emit control signals to at least one of the auxiliary valves as a response to the result of the comparison in order to adjust fluid flow in the fluid conduit related to said at least one of the auxiliary valves.

8. System according to claim 1, wherein the system includes user input entry means for allowing an operator to enter data related to one or more from the group: drill bit properties, drill rod properties, rock properties, requested drill mode.

9. System according to claim 1, wherein the auxiliary control system is a plug-in system for the adaption to a previously existing manual system.

10. System according to claim 1, wherein the auxiliary control system includes at least one sensor from the group: feed pressure sensor, rotation pressure sensor, impact hammer pressure sensor.

11. System according to claim 1, wherein the auxiliary control system includes at least one flushing air or flushing water pressure sensor.

12. System according to claim 1, wherein the auxiliary valves include fluid restriction and/or fluid reversing capabilities for the respective fluid conduits.

13. System according to claim 1, wherein the auxiliary control unit includes means for initiating a drilling operation sequence according to certain parameter data level/combination, whereby said sequences can include one or more functionalities from the group: anti jamming, anti plunging, anti plugging, synchronized threading and hammer power regulating.

14. Rock drill rig including a carrier vehicle with a feed beam whereon is movably supported a rock drilling machine, wherein a hydraulic fluid control system according to claim 1 is included for the control of pressure fluid supply to consumers being a feed motor, a percussion device and a rotation motor, said system including a regulating valve for each one of the consumers, wherein fluid conduits lead between the regulating valves and the respective consumers, the system having:

an electronically controlled auxiliary control unit which includes at least one electronically controlled auxiliary valve for the connection to and intercepting in at least one of the fluid conduits, at least one sensor for sensing prevailing fluid parameter values in respect of at least one member of the rock drilling machine and sending sensor signals to the auxiliary control unit as a sensor input signal actual values, and a processor having at least one parameter sensor input signal entry for receiving said sensor input signal actual values and at least one control signal exit for signal control of a respective auxiliary valve, wherein the processor is arranged to compare said sensor input signal actual values with parameter predetermined values and to emit control signals to at least one of the auxiliary valves as a response to the result of the comparison in order to adjust fluid flow in the fluid conduit related to said at least one of the auxiliary valves.

15. Method for the control of pressure fluid supply to consumers being a feed motor, a percussion device and a rotation motor of a rock drilling machine, said method including regulating fluid in conduits leading between regulating valves and the respective consumers through a regulating valve for each one of the consumers, wherein, connection to and intercepting in at least one of the fluid conduits is undertaken by an electronically controlled auxiliary control unit which includes at least one electrically controlled auxiliary valve, prevailing fluid parameter values in respect of at least one member of the rock drilling machine are sensed by at least one sensor and sensor signals are sent to the auxiliary control unit as sensor input signal actual values, and a processor having at least one parameter sensor input signal entry receives said sensor input signal actual values and exits at least one control signal for signal control of a respective auxiliary valve, wherein said sensor input signal actual values are compared with parameter predetermined values by the processor and control signals are emitted to at least one of the auxiliary valves as a response to the result of the comparison in order to adjust fluid flow in the fluid conduit related to said at least one of the auxiliary valves.

16. Method according to claim 15, wherein process fluid parameter values from one or more from the group are processed: feed motor pressure, percussion pressure and rotation motor pressure being related to the consumers, and the further parameters: flushing air pressure, flushing water pressure and damping pressure.

17. Method according to claim 16, wherein it includes user input entries for allowing the operator to enter data related to one or more from the group:

drill bit properties, drill rod properties, rock properties, requested drill mode.

18. Method according to claim 16, wherein a drilling operation sequence is initiated according to certain parameter data level/combination, whereby said sequences can include one or more functionalities from the group: anti jamming, anti plunging, anti plugging, synchronized threading and hammer power regulating.

19. Method according to claim 15, wherein it includes user input entries for allowing an operator to enter data related to one or more from the group: drill bit properties, drill rod properties, rock properties, requested drill mode.

20. Method according to claim 15, wherein a drilling operation sequence is initiated according to certain parameter data level/combination, whereby said sequences can include one or more functionalities from the group: anti jamming, anti plunging, anti plugging, synchronized threading and hammer power regulating.

* * * * *

UNITED STATES PATENT AND TRADEMARK OFFICE

CERTIFICATE OF CORRECTION

PATENT NO. : 8,905,157 B2
APPLICATION NO. : 13/261073
DATED : December 9, 2014
INVENTOR(S) : Jiao et al.

It is certified that error appears in the above-identified patent and that said Letters Patent is hereby corrected as shown below:

On the title page item [86] insert

--This patent claims the benefit of PCT/US09/03845, filed on June 26, 2009.--.

In the specification

Column 4, Line 19: Delete "11-16", and insert --I1-I6--.

Signed and Sealed this
Tenth Day of March, 2015

Michelle K. Lee

Michelle K. Lee
*Deputy Director of the United States Patent and Trademark Office*